US006261187B1

(12) United States Patent
Tsai

(10) Patent No.: US 6,261,187 B1
(45) Date of Patent: Jul. 17, 2001

(54) RACK FOR RETAINING BALLS

(76) Inventor: Chin-Ho Tsai, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/273,960

(22) Filed: Mar. 22, 1999

(51) Int. Cl.[7] ..... A63D 15/00
(52) U.S. Cl. ..... 473/40; 473/21; 473/26
(58) Field of Search ..... 473/40, 41, 21, 473/26; 482/44

(56) References Cited

U.S. PATENT DOCUMENTS 283,732 * 8/1883 Wiggins ..... 473/40
1,660,626 * 2/1928 Rhoads ..... 473/40
2,273,239 * 2/1942 Weicker ..... 473/40
3,992,005 * 11/1976 Richey ..... 473/40

* cited by examiner

*Primary Examiner*—Jeanette Chapman
*Assistant Examiner*—M. Chambers
(74) *Attorney, Agent, or Firm*—Charles E. Baxley

(57) ABSTRACT

A rack includes three sides each having a protrusion on the first end thereof and a recess defined in the second end thereof so that the three sides are connected to be a triangle rack by engaging the three protrusions with the three recesses. Each side has two grooves defined in the inside thereof and two ridges extending from the outside thereof. Three separators each have two protrusions for being engaged with the corresponding grooves of the three sides to from a small triangle or a rhombus. Each separator has two concavities defined in the inside thereof so as to receive the ridges when attached to the outside of the sides.

9 Claims, 4 Drawing Sheets

RACK FOR RETAINING BALLS

FIELD OF THE INVENTION

The present invention relates to a rack for retaining balls in a billiards or snooker, and more particularly, to an improved rack comprising three sides and three separators. The three sides can be engaged with each other to form a triangle and the separators are engaged between the three sides to form a rhombus or a small triangle.

BACKGROUND OF THE INVENTION

Billiards or snooker is a popular indoor game and includes a variety types of games such as carom billiards and snooker. The balls are retained in a rack at the beginning of the game on the pool so that when the rack is removed, the balls are arranged in the desired shape. FIGS. 1 and 2 respectively show the two popular racks which are the rhombus rack and the triangle rack. Each of the racks is made to be a one-piece member and comprises a plurality of sides (1) so as to enclose a space (11) therebetween for the balls (2) being received therein. Both of the two types of racks (1) need a large mold so that when using a plastic injection method to manufacture the racks, the cost for the mold is so expensive that the price of the racks cannot lowered. Furthermore, because the racks are made integrally to be a one-piece member so that it needs a lot of space no matter storage or transportation.

The present invention intends to provide a rack which is composed by at least three sides each having an engaging end and a receiving end so that the rack can be easily assembled or disassembled. The present invention mitigates and/or obviates the disadvantages of the conventional racks.

SUMMARY OF THE INVENTION

In accordance with one aspect of the present invention, there is provided a rack comprising three sides each having a protrusion extending from the first end thereof and a recess defined in the second end thereof. The first protrusion is sized to be engaged with the recess so that the three sides can be connected to form a triangle by engaging the protrusions with the recesses.

The main object of the present invention is to provide a rack which can be disengagably assembled by three sides.

Another object of the present invention is to provide a rack further comprising three separators which can be connected between the three sides so as to form a small triangle between the three sides and/or a rhombus enclosed by two separators and two sides.

Further objects, advantages, and features of the present invention will become apparent from the following detailed description with appropriate reference to the accompanying drawings.

DETAILED DESCRIPTION OF THE PREFERRED EMBODIMENTS

Figure 2:
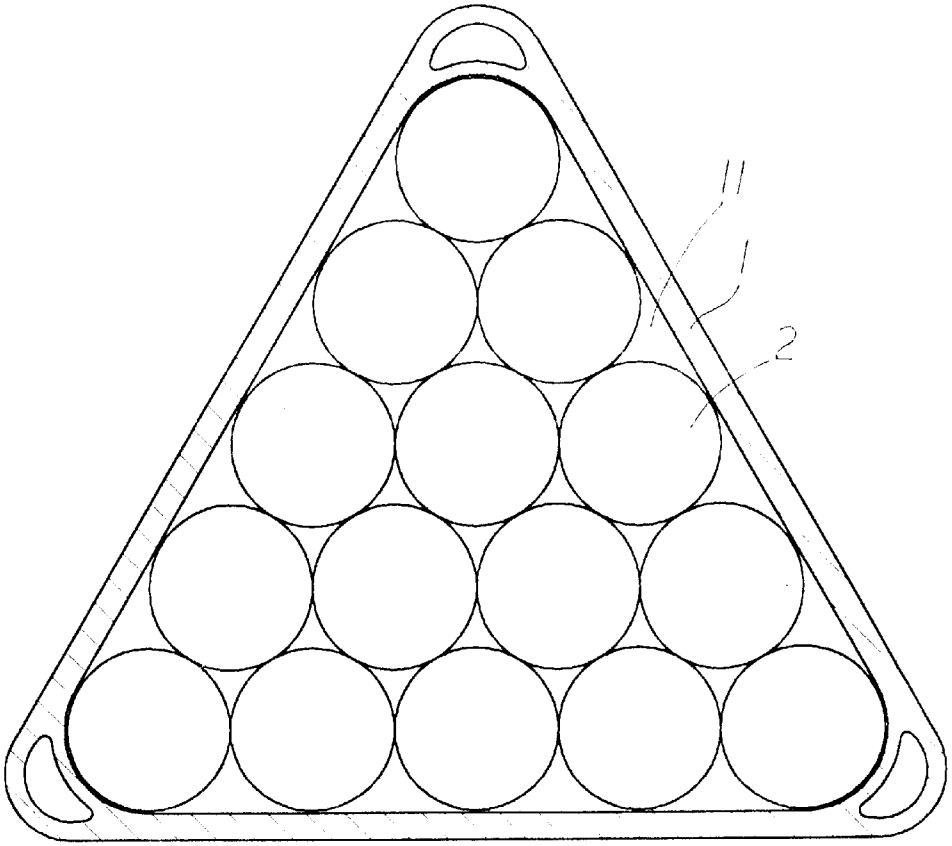
FIG. 2 PRIOR ART
FIG. 2 is a plan view to show balls are retained in a conventional triangle rack.
Figure 1:
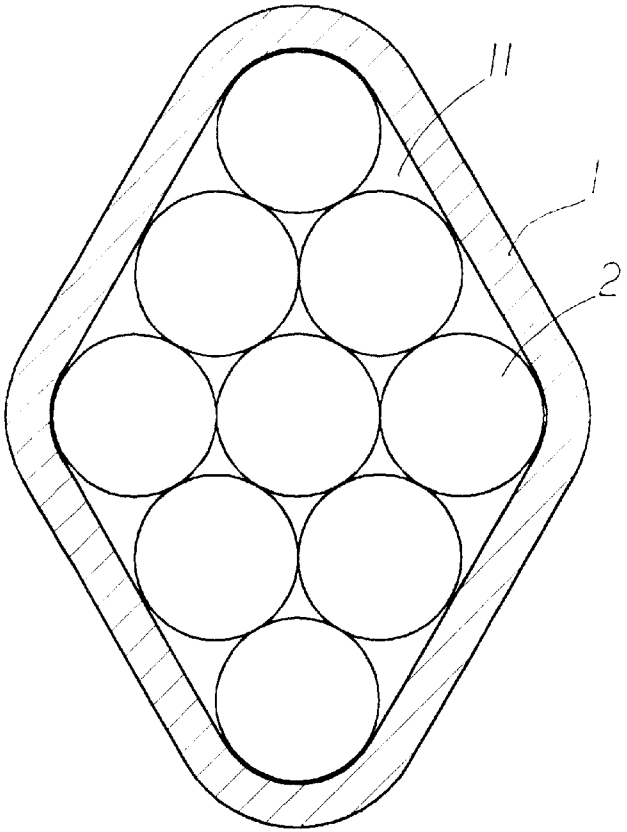
FIG. 1 PRIOR ART
FIG. 1 is a plan view to show balls are retained in a conventional rhombic rack.
Figure 3:
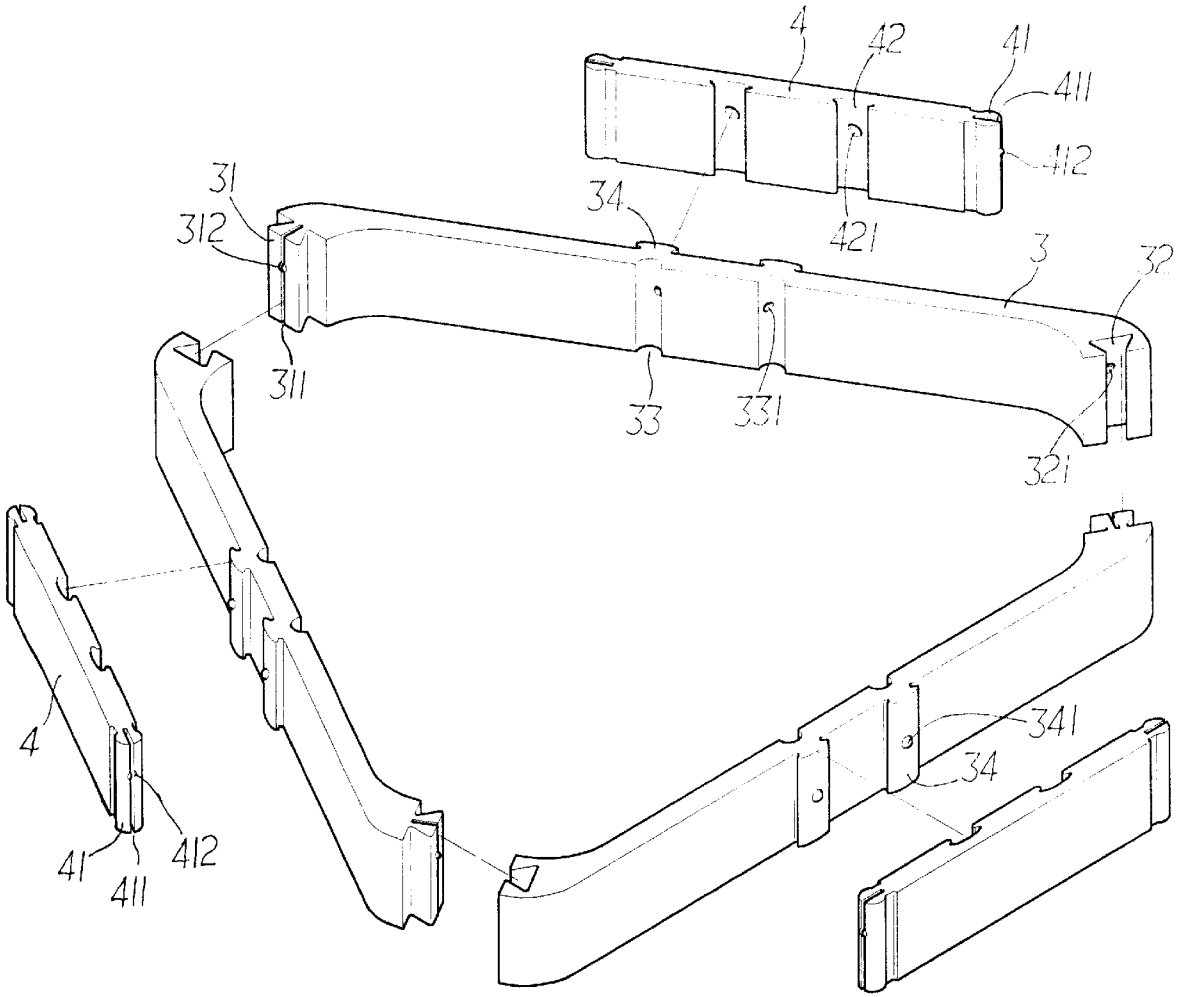
FIG. 3 is an exploded view of the rack in accordance with the present invention.
Figure 5:
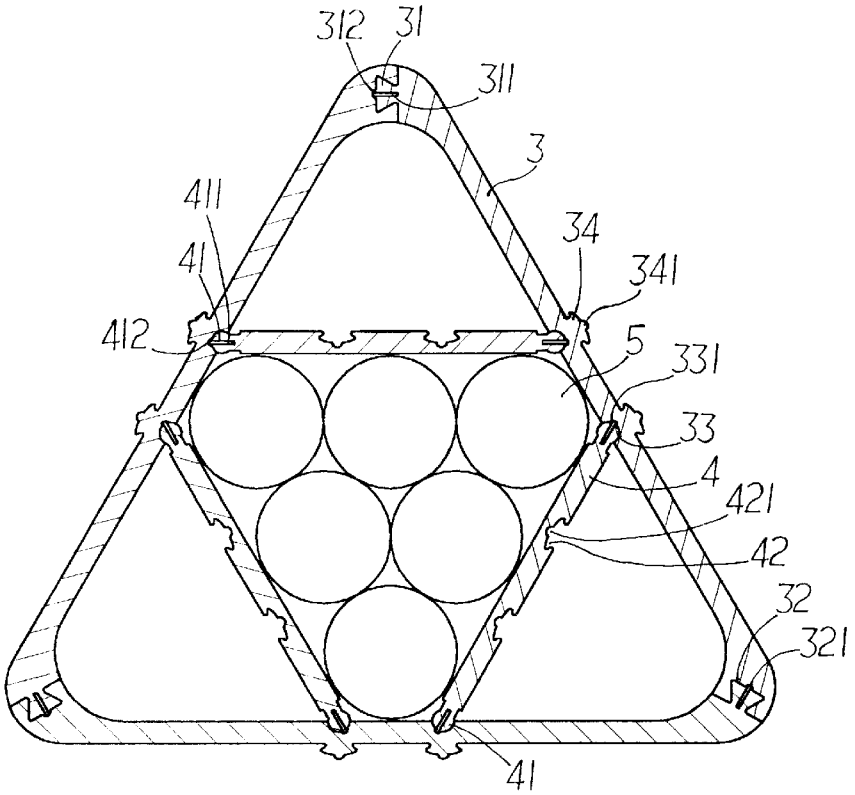
FIG. 5 is a plan view to show balls are retained in the rack in the from of a small triangle which is defined in the triangle rack.

Referring to FIGS. 3 and 5, the rack in accordance with the present invention comprises three sides (3) each having a first protrusion (31) extending from the first end thereof and a dove-tailed recess (32) defined in the second end thereof. The first protrusion (31) is sized to be engaged with the recess (32). Each first protrusion (31) has a slit (311) defined therein and a boss (312) extends from each of the two ends separated by the slit (311). Each recess (32) has a dent (321) defined in the bottom thereof so that when engaging each protrusion (31) with each recess (32), the boss (312) is received in the dent (321) corresponding thereto, and a triangle rack is constructed.

Three separators (4) each have two second protrusions (41) respectively extending from two ends thereof. Each second protrusion (41) has a slit (411) defined therein and a boss (412) extending therefrom each of the two ends separated by the slit (411). Each side (3) has two grooves (33) defined in the inside thereof and each groove (33) is sized to receive each second protrusion (41). Each groove (33) has a dent (331) defined in the bottom thereof so that the three separators (4) are able to be respectively connected between the three sides (3) by engaging each boss (412) with each dent (331). As shown in FIG. 5, the three separators (4) are connected to enclose a small triangle in the rack assembled by the three sides (3) so as to receive six balls (5) therein.

Figure 4:
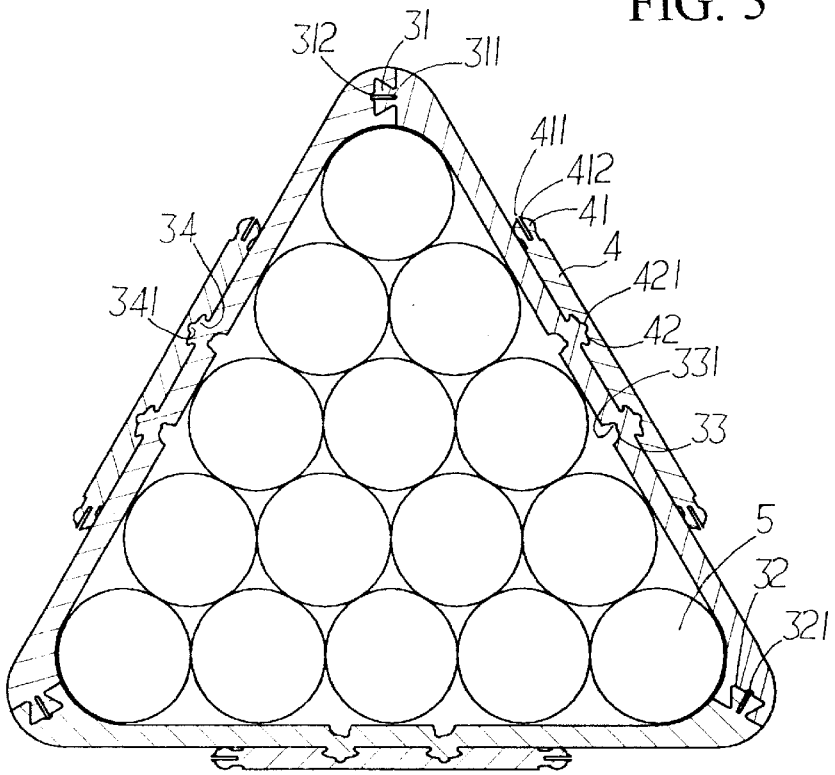
FIG. 4 is a plan view to show balls are retained in the rack in the from of a triangle.

Referring to FIGS. 3 and 4, each side (3) has two ridges (34) extending from the outside thereof and each separator (4) has two dove-tailed concavities (42) defined in the inside thereof, each ridge (34) being sized to be engaged with each concavity (42). Each ridge (34) has a boss (341) extending therefrom and each concavity (42) has a dent (421) defined in the bottom thereof so that the three separators (4) are attached to the outside of the three sides (3) by engaging each boss (341) with each dent (421).

Figure 6:
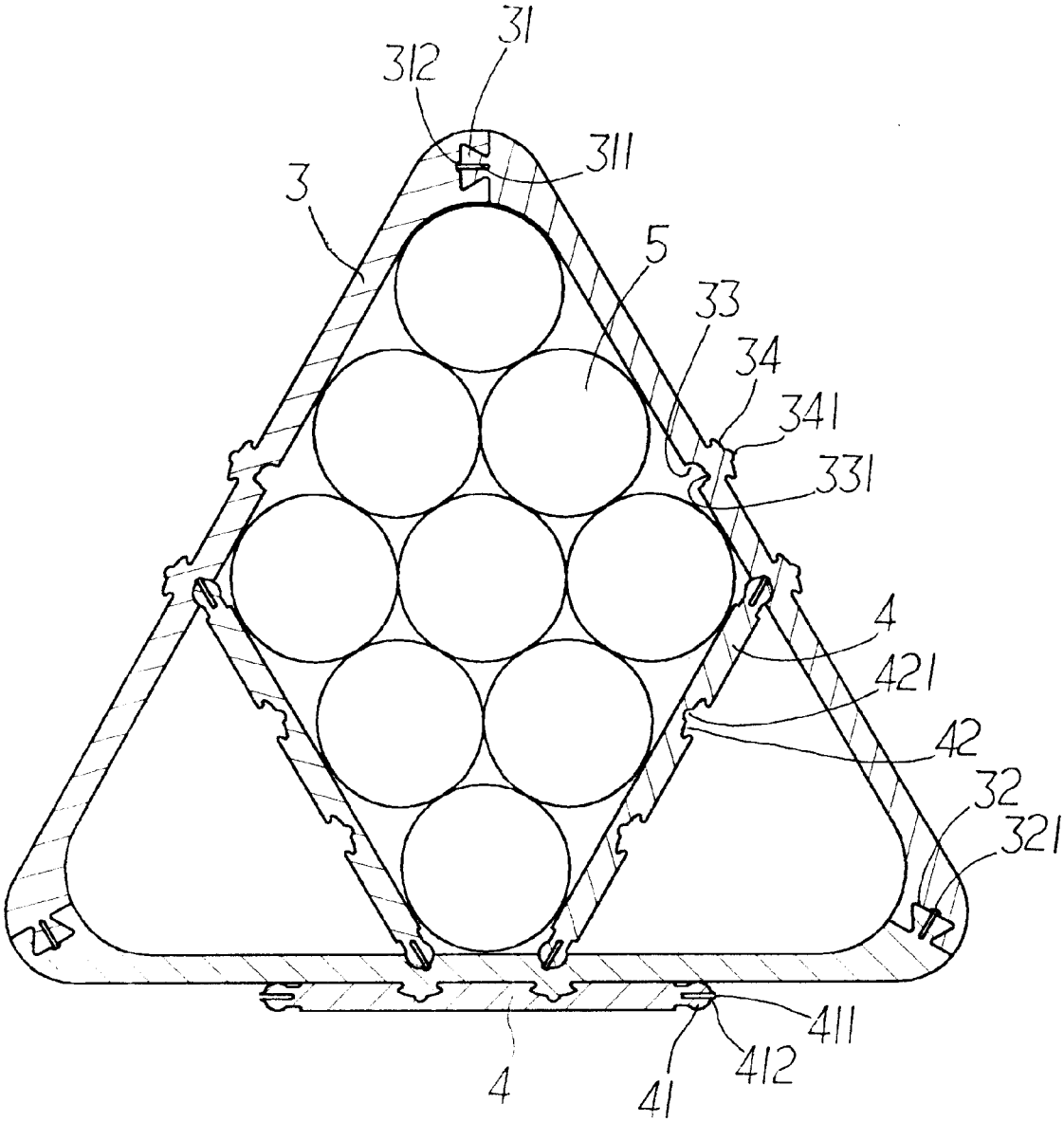
FIG. 6 is a plan view to show balls are retained in the rack in the from of a rhombus which is defined in the triangle rack.

FIG. 6 shows that only two separators (4) are used to be connected between the three sides (3) so as to enclose a rhombic space between the two separators (4) and the two sides (3). Therefore, nine balls (5) are received in the rhombic space.

The rack in accordance with the present invention can be disassembled into at least three thin members which are conveniently transported and stored. The rack can be easily used to change the retaining space so as to retain different numbers of balls (5).

The invention is not limited to the above embodiment but various modification thereof may be made. It will be understood by those skilled in the art that various changes in form and detail may made without departing from the scope and spirit of the present invention.

What is claimed is:

1. A rack comprising:

three sides (3) each having a first protrusion (31) extending from the first end thereof and a recess (32) defined in the second end thereof, said first protrusion (31) being sized to be engaged with said recess (32), and three separators (4), each of said separators (4) having two second protrusions (41) respectively extending from two ends thereof, each side (3) having two grooves (33) defined in the inside thereof and each groove (33) sized to receive each second protrusion (41).

2. The rack as claimed in claim 1, wherein each first protrusion (31) has a slit (311) defined therein.

3. The rack as claimed in claim 1, wherein each first protrusion (31) has a boss (312) extending therefrom and each recess (32) has a dent (321) defined in the bottom thereof.

4. The rack as claimed in claim 1, wherein each recess (32) is a dove-tailed recess.

5. The rack as claimed in claim 1, wherein each second protrusion (41) has a slit (411) defined therein.

6. The rack as claimed in claim 1, wherein each second protrusion (41) has a boss (412) extending therefrom and each groove (33) has a dent (331) defined in the bottom thereof, each dent (331) sized to receive each boss (412).

7. The rack as claimed in claim 1, wherein each side (3) has two ridges (34) extending from the outside thereof and each separator (4) has two concavities (42) defined in the inside thereof, each ridge (34) sized to be engaged with each concavity (42).

8. The rack as claimed in claim 7, wherein each ridge (34) has a boss (341) extending therefrom and each concavity (42) has a dent (421) defined in the bottom thereof, each dent (421) sized to receive each boss (341).

9. The rack as claimed in claim 7, wherein each concavity (42) is a dove-tailed concavity.

* * * * *